United States Patent [19]

Hovis et al.

[11] Patent Number: 4,904,283

[45] Date of Patent: Feb. 27, 1990

[54] ENHANCED FABRIC FILTRATION THROUGH CONTROLLED ELECTROSTATICALLY AUGMENTED DUST DEPOSITION

[75] Inventors: Louis S. Hovis, Cary; Norman Plaks, Raleigh; Bobby E. Daniel, Durham, all of N.C.

[73] Assignee: Government of the United States as represented by Administrator Environmental Protection Agency, Washington, D.C.

[21] Appl. No.: 257,119

[22] Filed: Oct. 11, 1988

Related U.S. Application Data

[63] Continuation of Ser. No. 129,395, Nov. 24, 1987, abandoned, which is a continuation of Ser. No. 824,817, Jan. 31, 1986, abandoned.

[51] Int. Cl.[4] ..... B03C 3/00

[52] U.S. Cl. ..... 55/131

[58] Field of Search ..... 55/2, 131, 139, 151, 55/152

[56] References Cited

U.S. PATENT DOCUMENTS

| | | | |
|---|---|---|---|
| 945,917 | 1/1910 | Cottrell | 55/2 |
| 1,931,436 | 10/1933 | Deutsch | 55/131 |
| 3,483,671 | 12/1969 | Wiemer | 55/136 |
| 3,577,705 | 5/1971 | Sharlit | 55/4 |
| 3,839,185 | 10/1974 | Vicard | 55/131 |
| 3,915,676 | 10/1975 | Reed et al. | 55/112 |
| 3,930,815 | 1/1976 | Masuda | 55/123 |
| 4,481,017 | 11/1984 | Furlong | 55/12 |

FOREIGN PATENT DOCUMENTS

| | | |
|---|---|---|
| 110774 | 10/1917 | United Kingdom . |
| 413800 | 7/1934 | United Kingdom . |

OTHER PUBLICATIONS

"Fabric Filtration With Integral Particle Charging and collection in a Combined Electric and Flow Field", Norman Plaks, Dissertation Submitted to the Graduate Faculty of Tokyo University, Jan. 30, 1987.

*Primary Examiner*—Bernard Nozick

[57] ABSTRACT

A simple electrostatically enhanced fabric filtration system for removing fine particulate matter or dust entrained in a gas flow, has a single, elongate, central, corona-generating electrode positioned within a cylindrical fabric filter, closed at one end, into which the particulate bearing gas flow is directed. In one embodiment, a grid-like cylindrical grounded electrode is disposed proximately outside the filter element and establishes a radially directed electrostatic field with the corona electrode. Particles passing through the corona acquire charges of like polarity and are subjected immediately to Coulombic forces driving them radially outward toward the filter fabric where they collect prominently near the filter element inlet, thus allowing easier passage to the gas further downstream. Other embodiments have a plurality of grounded electrodes attached to the inside of the filter element or as wires woven therethrough. Corona concentration near the filter element entrance by known techniques, e.g., roughening, addition of points to, or by changes in cross-section of the corona electrode, can also be utilized to further enhance all embodiments.

5 Claims, 3 Drawing Sheets

ENHANCED FABRIC FILTRATION THROUGH CONTROLLED ELECTROSTATICALLY AUGMENTED DUST DEPOSITION

This application is a continuation of application Ser. No. 129,395, filed Nov. 24, 1987; now abandoned, which is a continuation of application Ser. No. 824,817, filed Jan. 31, 1986, now abandoned.

TECHNICAL FIELD

This invention relates to apparatus for electrostatically enhanced fabric filters to remove dust from dust laden gas flows.

BACKGROUND OF THE INVENTION

There are many industrial processes, e.g., in the operation of steel-making furnaces, coal-fired electrical power generation plants, and the like, which produce substantial gas flows with particulate matter entrained therein. For such an operation of any significant size the amount of particulate matter or dust entrained in such gas flows is substantial and it is generally illegal, expensive and impractical to release the dust laden gases directly into the atmosphere. In a preliminary step, centrifugal separators, cyclone separators, and the like, can be used to remove the larger particles from the flow. However, the remaining finer particulate matter upon release into the atmosphere tends to disperse widely and therefore tends to irritate even distant neighbors of such an industrial operation and must be filtered out carefully and efficiently.

Simple fabric type filters, generally disposed in plural arrays in so called "baghouses", have been used in the past. Such systems generally require substantial electrical power to operate the blowers that drive the dust-laden gas flow through the filters which tend to get easily clogged and are generally short lived. Numerous solutions have been tried to utilize electrostatic forces to enhance dust filtration in a manner that relieves some of these problems. Each industrial application poses its own unique problems which depend, for example, on the ratio of gas to dust, humidity of the flow, temperature of the flow, particle average size, gas and/or particle chemical properties and the ever present need to conserve energy, reduce operational expense, and require minimum space for the filtration facility.

Regardless of the specific filtration technique that is used, the separated particulate matter or dust periodically must be physically removed from the facility, and that dust which clings closely to the fabric must be substantially separated away therefrom. One commonly used technique is to briefly but deliberately reverse the air flow through the fabric, thereby dislodging a substantial amount of the dust which otherwise would tend to impregnate and clog the spaces between the fabric fibers. Such systems are often called "reverse air" systems.

It is well known that similarly charged particles repel each other. This phenomenon can be exploited in electrostatically enhanced fabric filtration systems by providing the dust particles with a charge of a particular polarity, such that they will not clog up the filter element because they tend to repel each other adjacent to that filter element. As a result, a charged gas-permeable cake of similarly charged particles locates adjacent the air filter and continues to repel other particles while permitting the carrier gas to flow through the particle assembly and the filter itself.

U.S. Pat. No. 3,910,779 to Penney, titled "Electrostatic Dust Filter", discloses such a system in which the particulates in a gas stream are electrically charged in a corona region and are then carried by the gas stream to a separate filtering region downstream of the corona charging region. In the filtering region, a textile fabric is mounted on a metallic support structure, with a non-corona electric field being maintained at the collecting surfaces of the filter. According to this technique, no corona should be permitted near the particulate collecting surfaces of the filter.

U.S. Pat. No. 4,354,858 to Kumar et al, titled "Method for Filtering Particulates", discloses a filter medium comprising a porous cake, composed of electrically charged particulates previously drawn from the gas stream and collected on the upstream one of two foraminous support structures. The apertures of this upstream foraminous support structure are larger than the average size of the particulates that are to be filtered from the gas stream by more than an order of magnitude. The two foraminous structures are placed adjacent to each other and both are grounded at a point downstream of a plurality of high voltage corona discharge electrodes. As the charged particles pass through the upstream one of the pair of grounded foraminous structures, some of them eventually attach themselves to the downstream structure and build up a charge which repels like charged particles that are approaching it with the carrier gas. Shortly, a porous particulate cake builds up upstream of the upstream foraminous structure and permits the carrier gas to pass through. Kumar et al disclose one embodiment that has the form of two coaxial cylinders, of which the inner one has the larger apertures and constitutes the upstream foraminous structure. Gas flows axially into the cylindrical structure and radially outward through both the foraminous structures which are grounded. An axially oriented central electrode coacts with the foraminous structures to provide a radial electrostatic field.

The Penney structure with its corona generating field and a physically separated array of unidirectional electric fields between neighboring filter elements is relatively complex and requires a substantial amount of space. The Kumar et al system requires two carefully graduated foraminous structures, both of which are electrically conducting and grounded.

A need therefore exists for an electrostatically enhanced fabric filtration system to separate particulate matter or dust from a gas stream, which has a relatively simple structure, utilizes known filter fabrics, is inexpensive to build and maintain, requires little space, and is operable with relatively simple electrical circuitry.

DISCLOSURE OF THE INVENTION

It is an object of this invention to provide an electrostatically enhanced fabric filtration system, for the removal of particulate matter or dust from a gas stream, which is simple to construct and operate.

It is another object of this invention to provide an electrostatically enhanced fabric filtration system, for the removal of particulate matter or dust from a gas stream, employing known reverse-air bags made of fabric common to reverse-air applications.

It is yet another object of this invention to provide an electrostatically enhanced fabric filtration system, for the removal of particulate matter or dust from a gas stream, in which a nonenergized electrode is made integral with the filter bag element itself.

These and other objects and benefits of the invention are realized by providing in one embodiment thereof a substantially cylindrical known fabric filter element, supported at one end by a substantially rigid sleeve through which particulate-laden gases enter and closed at another end by a cap through which is supported an insulated long axially aligned corona electrode charged to a high voltage with respect to a ground. In this embodiment, a grounded conductive cylindrical grid electrode is positioned around but close to the filter element. The corona electrode charges up the incoming particulates, and the radial electric field between the corona electrode and the grounded grid electrode drives the charged particles toward the filter fabric. In another embodiment, the grounded electrodes take the form of flexible, preferably braided, wire electrodes at the inside surface of the filter element. In yet another embodiment, a filter fabric containing grounded wires woven through it eliminates the need for separate grounded electrodes or a grounded grid outside the filter.

BRIEF DESCRIPTION OF THE DRAWINGS

Like numbers are used to identify like elements in the different drawings and in the discussion below.

BEST MODE FOR PRACTICING THE INVENTION

In any industrial facility of significant size, in which gas flows containing entrained particulate matter or dust have to be filtered, there is likely to be a filtration facility in the system to which the particulate laden gas flow would be directed. For convenience of operation and maintenance, it is common in such a facility to have a plurality of fabric filters conveniently arrayed to each receive some of the overall gas flow, preferably through independently closeable valves. Thus one or more filter elements may be taken out or added to the active filter elements at any time depending upon the facility repair, maintenance, or load requirement.

Figure 1:
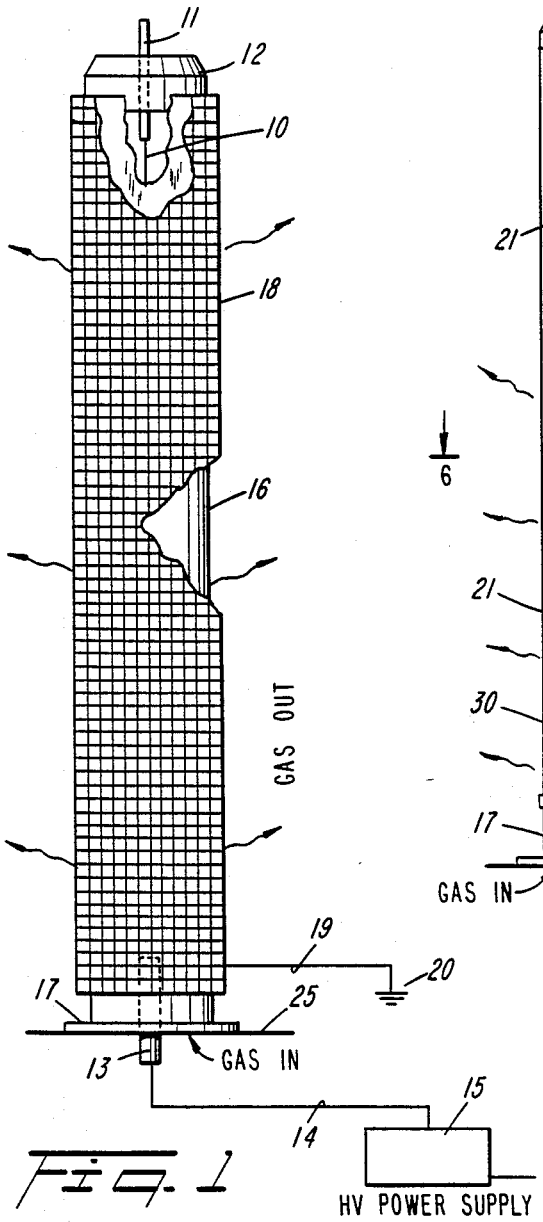
FIG. 1 is a partially cut-away elevation view of a first embodiment of this invention which includes an external, grounded, grid-type electrode outside a fabric filter bag closed at one end.

A typical electrostatically enhanced gas filter assembly, according to a first embodiment of this invention, as best seen in FIG. 1, has a long thin vertical corona electrode 10 supported at its top end by an insulating sleeve 11 that passes through and is fixed to a cap 12 that closes the upper end of a generally cylindrical fabric element 16. The insulator 11 is fixed to the cap 12 in a gas-tight relation whereby the cap and the insulator render the upper end of element 16 gas-tight. The lower end of the fabric element 16 is kept open and held at its lower end by an open ended, rigid metal sleeve 17 that is grounded and to which the element 16 is fastened in any suitable manner. For example, a metal band (not shown) may be used to clamp the element 16 to the sleeve 17. The lower end of the corona electrode 10 passes through the sleeve 17 and is connected to an electrical line 14 which in turn is connected to a high voltage power supply 15. Base 25 has an aperture (not numbered) that permits unimpeded flow of gas through sleeve 17 mounted thereabove and into the volume between corona electrode 10 and the filter element 16.

An electrical insulator 13 surrounds the electrode 10 at that part of its length that passes through the sleeve 17. While the insulator 13 is not vital to the satisfactory operation of the invention, it does serve a useful purpose. The insulator 13 surrounds the electrode 10, thereby preventing the formation of a corona at the part of the electrode which it surrounds. This occurs at the part of the electrode that passes through the sleeve 17. In this region it is desirable to prevent a corona, so as to prevent formation of an electrostatic field between the electrode and the grounded metal sleeve 17. By virtue of being held in the insulator 11 which is fixed in the cap 12 and its passage through the insulator 13, the corona electrode 10 is centrally and firmly supported within the fabric filter element 16 and insulated thereform. A grid or mesh-like wire electrode element 18 closely surrounds filter element 16 but is not in contact with it. The grid electrode 18 is connected via line 19 to ground 20.

During operation of the instant electrostatically enhanced fabric filtration system, the establishment of a high voltage potential between the corona electrode 10 and the ground creates a corona discharge along the corona electrode. This, in turn, charges the dust particles surrounding it to impart to them a charge of like polarity. Simultaneously, the cylindrical configuration of the external grounded grid electrode 18 coaxial with the corona electrode 10 creates an electrostatic radially directed field between them. Therefore, upon acquiring a charge from the corona discharge of the electrode 10, each dust particle becomes subjected to Coulombic electrostatic forces which will cause it to migrate toward the lower potential grid 18, i.e., radially outward toward the fabric of the filter element 16, thus reaching it more rapidly than it would if it were carried only by the streamlines of the gas flow as it leaks through the fabric without this enhancement.

In actual field tests of this embodiment, it was observed that there was a much greater concentration of collected particulate matter in the lower portion of the bag, i.e., close to the entrance of the filter element. It was further observed that as the particulate mass collected it tended to build up over time and tended, therefore, to restrict the passage of the gas through the filter element at the bottom. The gas, which has now lost at least some of the dust that it had entrained within, therefore seeks a path of lower resistance to flow, and penetrates the fabric of the filter element 16 higher up where the dust deposit thickness is less. It should be noted that as the gas flows up the filter element 16 the remaining entrained dust particles are still charged and are electrostatically forced radially out toward the bag all along its length because of the prevailing difference in electrostatic potential between the corona electrode 10 and the grid electrode 18 immediately outside the filter element 16.

The thickening dust cake will gradually move up the bag during the collection cycle. In other words, more and more dust will be located inside and adjacent to the fabric element but the thickness of this deposit 30 will always be greater near the bottom of the fabric element with the upper portion thereof providing relatively free passage of the carrier gas therethrough. See FIG. 2. As persons skilled in the art of fluid mechanics will appreciate, this swift or enhanced extraction of the dust from the dust laden gas provides a relatively easy passage of the gas through a substantial portion of the filter element, and this is accompanied by a smaller overall gas pressure drop through the filter element.

Filtration enhancement attributable to the above-described mode of particulate deposition depends initially upon the intensity of the corona discharge, and this varies with the established voltage difference between the corona electrode 10 and the external grid electrode 18 for a given size of the corona electrode. It should also be appreciated that the efficacy of such filtration enhancement depends also on the strength of the electrical field established between the corona electrode and the external grid electrode, and this varies directly with the established voltage difference and inversely with the radial distance between them.

For a practical empirical study of the filtration enhancement so obtained, a quantity termed "the pressure difference ratio", i.e., the ratio of the measured pressure drop rise or PDR during a typical filtration cycle with the electrostatic field "on" as compared to the corresponding pressure drop rise during the same cycle with the electrostatic field "off" is defined. Several such experiments were conducted, and the data obtained therefrom is tabulated in Table 1 below. From Table 1 it is apparent that for corona electrodes in the form of ⅛ in. or ¼ in. diameter wires and for an impressed electrode voltage of between 19 and 22 kv, for dust laden gas at between 200°–300° with or without appreciable moisture, PDR values of between 0.29 and 0.47 are realizable. The obvious conclusion is that considerably less power would be required for motor-driven blowers to drive the dust laden gas through the filtration elements when electrostatic enhancement is provided by the corona discharge and electric field between the corona electrode and the grounded electrode according to this invention. This is a significant advantage leading to a more efficient dust filtration system.

Table 1 presents experimental data obtained with apparatus according to this invention, indicative of PDR at selected electrode voltage valves for different electrode diameters under various operating temperatures and humidity conditions.

TABLE 1

EFFECT OF CENTER WIRE ELECTRODE ON FILTRATION PRESSURE DROP

| Electrode Type | Electrode Voltage KY** | PDR = ($\Delta P_D$ field on/ $\Delta P_D$ field off) | Remarks |
|---|---|---|---|
| ⅛ in wire | 22 | .29 | 200° F., moisture added |
| ¼ in + ⅛ in wire | 20 | .33 | 300° F., moisture added |
| ⅛ in wire | 19 | .44 | 200° F., dry |
| ⅛ in wire | 21 | .34 | 300° F., moisture added |
| ⅛ in wire | 19 | .47 | 300° F., dry |

In use, over time, there will be a substantial collection of dust within each fabric element and, in a convenient known manner a temporary reversal of the gas flow therethrough is sufficient to dislodge substantially all of the dust accumulated inside the fabric element, including some that may have penetrated the pores thereof. Most such systems can be conveniently programmed to provide such controlled reversal of air flow at set predetermined itervals related to the overall gas flow or other operating conditions. As was noted previously, by providing a plurality of such filtration elements in a predetermined array, with suitable ducting connecting them to the main dust laden gas flow, it should be possible to include or exclude selected filtration elements from operation. Because each fabric element and electrodes and their disposition all involve very simple structures, it is possible to maintain or replace elements thereof with economy and efficiency. Naturally, the enhancement of the filtration is continuous so long as the required electrostatic potential is maintained.

After each reverse-air cleaning cycle, the collection process begins anew with a preponderance of the dust being collected thereafter in the bottom portion of the fabric element. This was verified by experiments in which a provision was made to open the bag for a determination of the mass of deposited dust as a function of the distance measured from the bottom of the fabric element. Some of the data from these experiments are presented in Table 2 below. Note that the greatest proportion of dust was collected near the bottom of the filter element or "bag" when the voltage was maintained as high as possible without sparking, i.e., close to 22 kv. Without an impressed voltage on the central or corona electrode, and when it was maintained below a certain threshold, the dust collection was found to be spread uniformly over the inside of the filter element surface as is the case with conventional unenhanced fabric filtration. This may be regarded as a situation when PDR=1. When sparking occurs across the space between the corona electrode and the outside grid electrode, the efficiency of charging the particulate matters drops off drastically and the desired electrostatic enhancement ceases.

Table 2 presents experimental data obtained with apparatus according to this invention, indicating how the dust collection is distributed in the vertical direction as a function of electrode voltage.

TABLE 2

| DUST DEPOSITION: CENTER WIRE ELECTRODE: 4 FT BAG | | |
|---|---|---|
| Electrode Voltage | % Dust Collection; measured on 2 λ 2 inch patch | |
| KY | 4 inches from bottom | 8 inches from top |
| 22 | 58.1 | 11.4 |
| 16 | 55.9 | 14.8 |
| 8 | 39.9 | 28.9 |
| 0 | 37.5 | 30.3 |

If there are variations in the composition of the dust carrying gas, its temperature, the composition of the particulate matter entrained therein, or its moisture content thereof, then the overall system control should take this into account in adjusting the electrode voltage impressed upon the corona electrode with respect to ground. Such controls are well known and readily available to persons skilled in the art.

There is good indication that the site on the central corona wire at which the effective corona discharge is provided can strongly influence the quantity of charge put into the particulate entrained in the incoming gas. Providing the corona discharge substantially near the inlet to the filter element is effective in charging essentially all the particulate matter entering the filter element. It is therefore of interest to consider techniques for providing the maximum corona discharge adjacent the entry to the filter element for the particulate laden gas flow.

Figure 4:
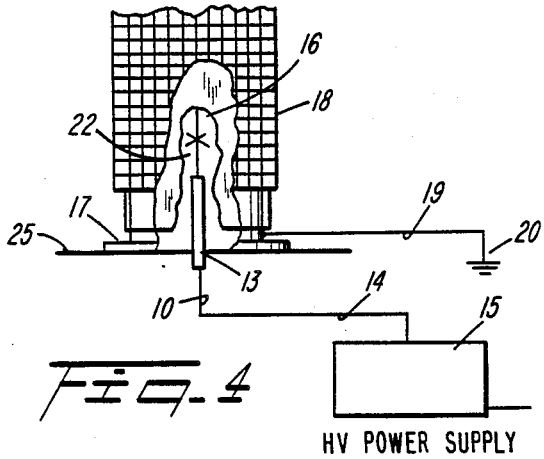
FIG. 4 is a partial cut-away vertical section of the lower portion of the embodiment of FIG. 1, showing sharp barbed type extensions on the central electrode.
Figure 5:
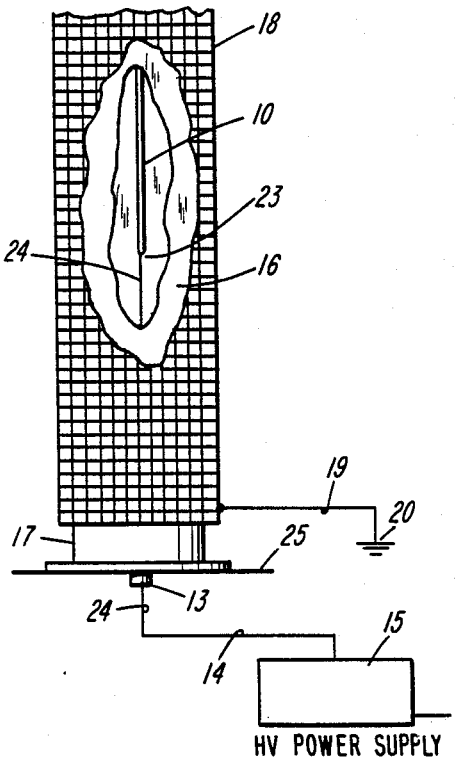
FIG. 5 is a partial cut-away elevation view of a portion of the embodiment of FIG. 1, showing a central electrode provided with a sharp change of cross-section.
Figure 6:
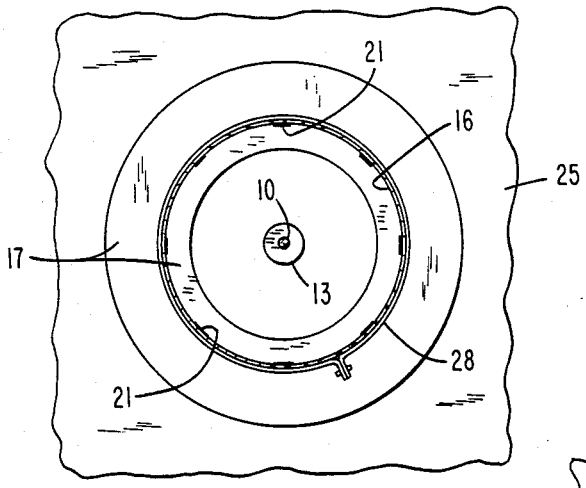
FIG. 6 is a horizontal cross-sectional view at Section 6—6 of the embodiment of FIG. 2.

There are three relatively inexpensive and convenient techniques for concentrating the corona discharge on an elongate corona element 10. The first of these is simply to provide a roughened surface to the corona element 10 at the position selected. A second approach is to provide a plurality of sharp short projections 22 on the corona electrode 10, as best seen in FIG. 4. Yet another approach, as best seen in FIG. 5, is to provide for the corona electrode 10 to be subjected to a sudden change in cross-section at a point 23 to, for example, a reduced diameter portion 24 close to the entrance to the fabric filter element. A series of short reduced diameter sections would be yet another alternative to a uniform diameter central corona electrode running the length of the entire filter element. Intensified corona will be generated at the reduced sections and the smaller the section the more concentrated the corona thereat.

Figure 2:
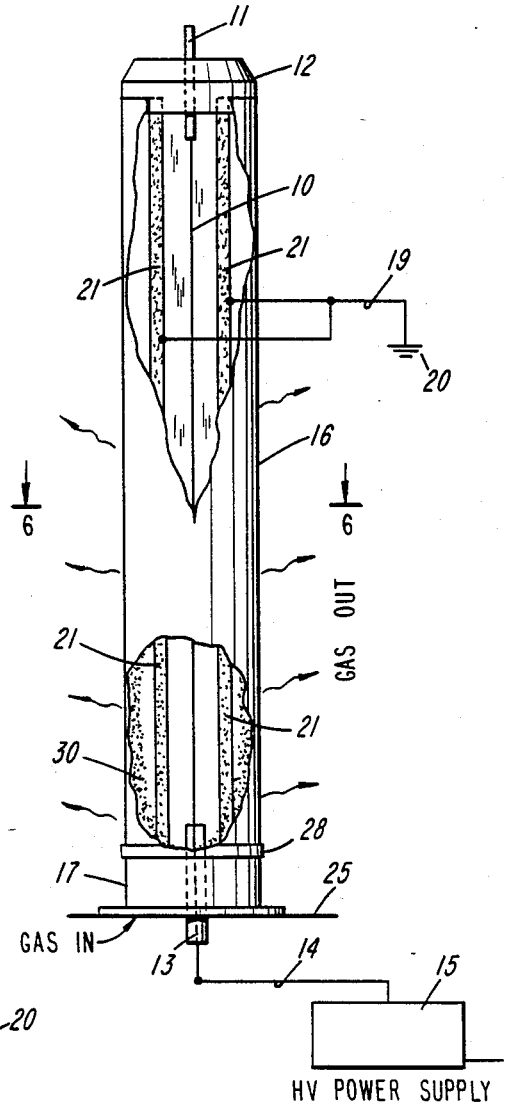
FIG. 2 is a partial cut away elevation view of a second embodiment of this invention with braided wire grounded electrodes inside a fabric filtration bag.
Figure 10:
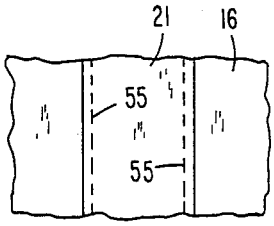
Figure 7:
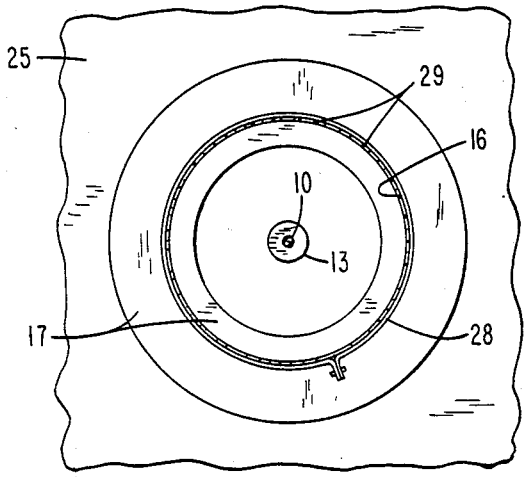
FIG. 7 is a horizontal cross-sectional view at Section 7—7 of the embodiment of FIG. 3.
Figure 8:
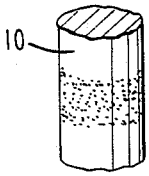
FIG. 8 is a perspective view of a portion of corona electrode 10 with a roughened surface.
Figure 9:
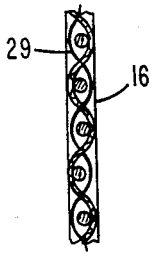
FIG. 9 is a vertical cross-sectional view of a portion of a fabric filter element of one embodiment of the invention.

The fact that in this invention the filter element is located in a region of lower electrical potential than the central corona wire offers other alternative configurations. Thus in another embodiment of this invention, as best seen in FIG. 2, a plurality of flexible elongate electrodes 21 may preferably be disposed close to the inner surface of the filter element, replacing the external grid-like electrode 18 of the previous embodiment. One version of the second embodiment would have elongate electrodes 21 in the form of braided wire sewn, e.g., by stitches 55 per FIG. 10 on to the inside surface of the fabric filter element 16. By appropriate connection of such braided electrodes 21 to ground, the required electrostatic potential between the central corona electrode 10 and electrodes 21 can be maintained during operation of the system.

Figure 3:
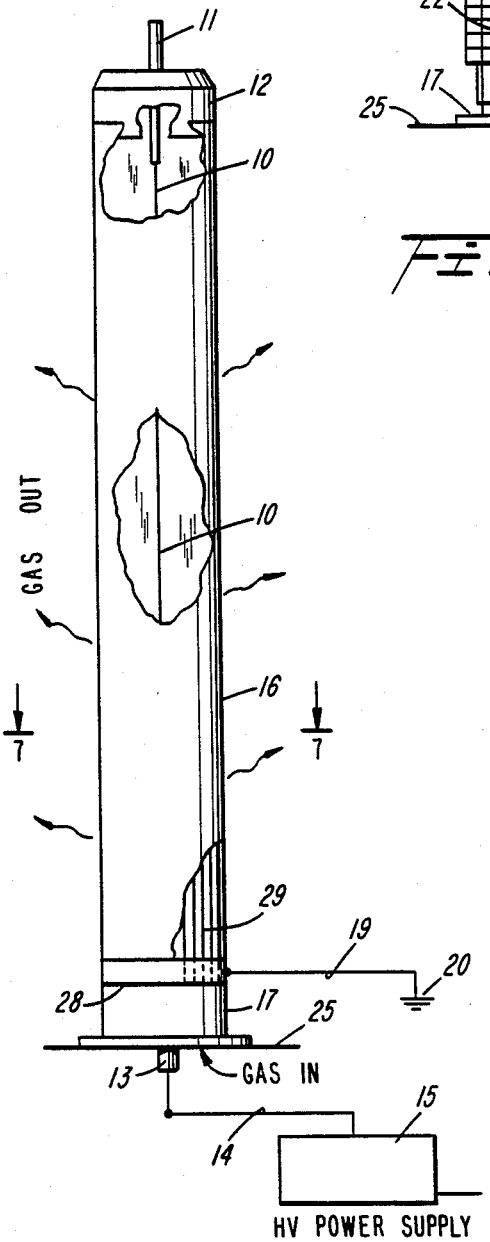
FIG. 3 is a partial cut-away elevation view of a third embodiment of this invention with the grounded electrode integral with the fabric filter bag.

In yet another embodiment, as best seen in FIG. 3, the fabric filter element 16 thereof may be made either of electrically conductive fabric which is grounded or may be constituted of a well known filtration fabric, e.g., woven fiber glass, with added electrically conductive wires 29 woven therethrough and grounded. Such grounding is conveniently accomplished by means of a metal band 28 in electrical contact with the conductive bag fabric or with conductive wires woven therethrough. In fact, in principle, a combination of the fabric filter element itself and a deposited layer of dust adjacent thereto could serve as the lower potential surface, provided the combination of the fabric and dust have low electric resistivity. A low filtration temperature would tend to favor the realization of such low fabric and dust resistivity.

Persons skilled in the art, upon comprehension of the above disclosure, will very likely consider other alternatives suggested herein, e.g., a short circular mesh or a circular conductive plate close to the bottom of the filter element. It is conceivable that even the walls of the filtration facility and strategically placed metal plates could provide requisite potential difference to electrostatically enhance migration of the dust toward the filter element fabric.

The primary advantages of this invention, in its various embodiments include a lower pressure drop achieved by the invention in comparison with a conventional unenhanced fabric filtration system having a comparable capacity for removal of particulate matter from a gas flow. This translates directly into an operating cost savings because the amount of power required to operate the fans or blowers for causing the gas to flow though the system would be significantly reduced.

Furthermore, more impressive savings can probably be realized in terms of the reduced capital costs for new dust filtration systems yet to be installed. Assuming that the level of the pressure drop normally encountered in such dust filtration facility designs can be tolerated in a facility that is provided with central corona electrodes according to this invention, the latter can be expected to be smaller in size and have fewer filtration elements, perhaps only one-third as many as for a conventional facility. This is borne out by the data of Table 1. Logically, therefore, with smaller and fewer filters required for a facility to perform a particular task, less land area and construction would also be required than is the case for conventional filtration facilities that are not electrostatically enhanced. This can be especially advantageous in cases of retrofitting of existing facilities or, for example, when an electrical power generation plant is converted from being oil-fueled to one utilizing pulverized coal as the fuel.

It should be apparent from the preceding that this invention may be practiced with geometries and sizes, related to specific uses, otherwise than as particularly described and disclosed herein. Such modifications, and others may therefore be made to the specific embodiments discussed above without departing from the scope of this invention, and such are intended to be included within the claims appended below.

What is claimed is:

1. An electrostatically enhanced fabric filtration system utilizing a high voltage source for separating particulate matter from a gas stream, comprising:

a substantially cylindrical fabric filter element having a first end and a second end and comprised at least in part of a grounded electrically conductive material;

a substantially rigid and substantially cylindrical open-ended metal sleeve member so attached to the first end of said filter element as to maintain said first end in open condition for communication therewith, said sleeve having a gas inlet aperture open to the interior of said sleeve and said filter element such that a particulate laden gas stream may flow through said aperture and said sleeve to the interior of the filter element;

a closure means at the second end of said filter element maintaining said second end in closed condition;

a linear corona electrode connected to said high voltage source to receive a high voltage therefrom relative to ground, coaxially disposed within said filter element and having one end attached to the closure means at the second end of the filter element and having its other end extended through said gas inlet aperture, said sleeve and said first end of said filter element;

an electrical insulating means interposed between said corona electrode and said closure means, whereby said electrode is electrically insulated from said filter element at said second end thereof;

an electrical insulating means surrounding said corona electrode for insulating said corona electrode from said sleeve at the region where the electrode extends through the gas inlet aperture and the sleeve;

whereby a corona discharge is generated along said corona electrode when a high voltage is applied to said corona electrode, said corona discharge providing an electrical charge to the particulate matter entering the filter element and simultaneously generating an electrostatic field between the corona electrode and said grounded electrically conductive material that is a part of said fabric filter element, whereby the charged particles are attracted toward an inside surface of the filter element under the influence of the electrostatic field.

2. An electrostatically-enhanced fabric filtration system according to claim 1, wherein:

said fabric filter element comprises fiber-glass fabric and said grounded conductive material comprises conductive wire filaments woven therein.

3. An electrostatically enhanced fabric filtration system according to claim 1, further comprising:

corona-intensification means on said corona electrode, at a predetermined location within said filter element coaxial therewith, for intensifying electrical corona thereat.

4. An electrostatically-enhanced fabric filtration system according to claim 3, wherein:

said corona-intensification means is provided close to said first end of said filter element.

5. An electrostatically-enhanced fabric filtration system according to claim 4, wherein: said corona-intensification means comprises a deliberately roughened portion on the exterior surface of said corona electrode.

* * * * *